US007240387B1

(12) United States Patent
Berggren

(10) Patent No.: US 7,240,387 B1
(45) Date of Patent: Jul. 10, 2007

(54) ORNAMENTAL BRIDGE KIT

(76) Inventor: John A. Berggren, 28735 SE. 462nd Pl., Enumclaw, WA (US) 98022

( * ) Notice: Subject to any disclaimer, the term of this patent is extended or adjusted under 35 U.S.C. 154(b) by 141 days.

(21) Appl. No.: 11/070,311

(22) Filed: Mar. 1, 2005

(51) Int. Cl.
*E01D 4/00* (2006.01)

(52) U.S. Cl. ..... 14/24; 14/2.4

(58) Field of Classification Search ..... 14/2, 14/2.4, 4, 24, 3, 25
See application file for complete search history.

(56) References Cited

U.S. PATENT DOCUMENTS 132,860 A * 11/1872 Russell ..... 14/4
265,331 A * 10/1882 Litell ..... 14/4
2,452,888 A * 11/1948 Woodward ..... 446/113
2,507,354 A * 5/1950 Spunberg ..... 446/105
3,768,108 A * 10/1973 Wadsworth ..... 14/24
4,649,688 A * 3/1987 Mosier ..... 52/644
4,965,903 A * 10/1990 Bish ..... 14/2.4
6,421,863 B1 * 7/2002 Tiffany ..... 14/2.4
6,631,530 B1 * 10/2003 Makofsky ..... 14/13
6,799,345 B2 * 10/2004 Occhiolini et al. ..... 14/12

* cited by examiner

*Primary Examiner*—Raymond Addie
(74) *Attorney, Agent, or Firm*—Christensen O'Connor Johnson Kindness PLLC

(57) ABSTRACT

An ornamental bridge kit includes a frame having a first and second side beams (10, 12) of a length that may fit within a shipping container. The frame further includes a plurality of transverse braces (16) spanning between the internal surface of the first side beam (10) and the internal surface of the second side beam (12). The frame also includes a plurality of lateral stiffeners (18) and at least one longitudinal stiffener (20) secured to the plurality of transverse braces (16). A plurality of boards or planks (52) may further be arranged transversely and extending from the first side beam (10) to the second side beam (12) and secured to the top edge of the first side beam (12).

15 Claims, 4 Drawing Sheets

ORNAMENTAL BRIDGE KIT

FIELD OF THE INVENTION

The present invention relates generally to an ornamental bridge, and more particularly, to an ornamental bridge kit that may be conveniently packaged and shipped to the purchaser for assembly.

BACKGROUND OF THE INVENTION

Ornamental bridges are commonly used in gardens and parks for both decorative and functional purposes. They can be used as a walkway over a stream or pond, or they can be added simply for visual pleasure.

To serve a functional purpose, a bridge must be well constructed to withstand a significant amount of pressure and force, and also durable such that it may last for an extended period of time. Such a reliable, sturdy bridge may not be accessible to a consumer who wishes to assemble the bridge without professional assistance. Moreover, many sturdy designs are not normally broken down into smaller components to allow for the packaging and delivery of an ornamental bridge kit to a residence, place of business, park, or elsewhere. For instance, the United Parcel Service™ requires that all packages be limited in length to 108 inches, or 9 feet. If the package is not limited to 9 feet, the shipper will incur extra costs to send the package. Thus, it is desirable that the kit parts be limited in length to conform to this requirement.

It is also desirable that the kit be conveniently transportable from a retail store to the consumer's home, for example in an SUV, a station wagon, or a pickup.

Based on the foregoing, there exists a need for an ornamental bridge kit that is shippable via standard shipping methods, and a kit that allows for fast, simple assembly of a reliable bridge.

SUMMARY OF THE INVENTION

One embodiment of an ornamental bridge kit formed in accordance with the present invention comprises a frame that includes a first side beam of a length that may fit within a shipping container. The first side beam has an internal surface, an external surface, a top edge, and a bottom edge. The frame also includes a second side beam of a length that may fit within a shipping container. The second side beam likewise has an internal surface, an external surface, a top edge, and a bottom edge. The frame further includes a plurality of transverse braces spanning between the internal surface of the first side beam and the internal surface of the second side beam. In addition, a plurality of stiffeners may be secured to the first and second side beams and the plurality of transverse braces. A plurality of deck boards are also arranged transversely on the frame, extending from the first side beam to the second side beam and secured to the top edges of the first and second side beams.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
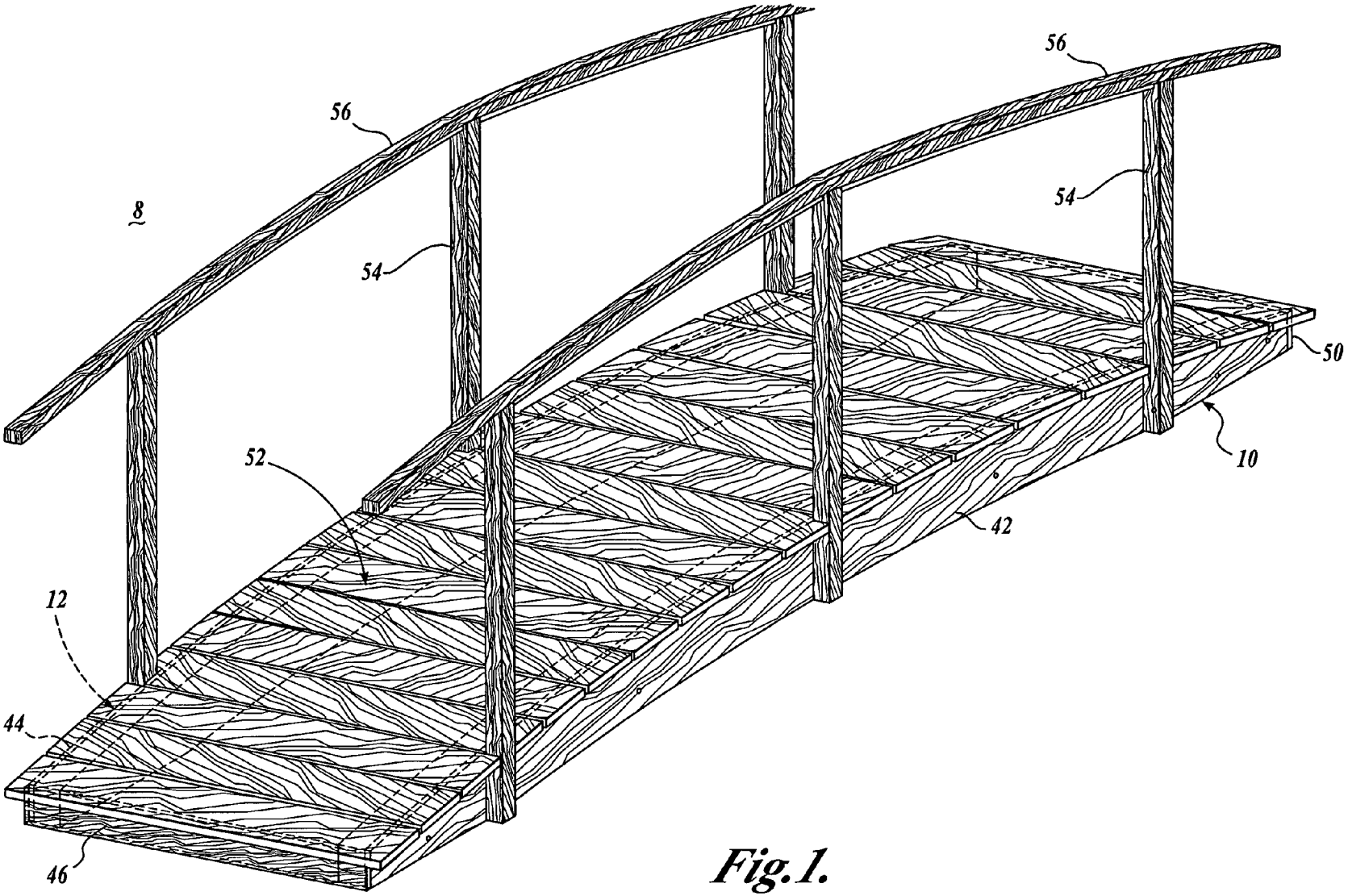
FIG. 1 is a perspective view of a complete bridge assembly.

Referring to FIGS. 1–4, one embodiment of the present invention is provided. Referring to FIG. 1, a complete ornamental bridge assembly 8 is shown. The ornamental bridge assembly 8 consists of an underlying frame, an external covering for the frame, and a plurality of boards or planks arranged transversely across the frame to form the bridge platform. The bridge is configurable in numerous sizes, including in lengths of, for example, 4, 8, 10, 12, 14, and 16 feet. For ease of illustration and clarity, the bridge and bridge components are shown in a substantially horizontal orientation, although it may be suitably shown in any orientation, such as vertical. Therefore, the terminology "vertical", "horizontal", "top", "bottom", etc., should be construed as descriptive and not limiting.

Figure 2:
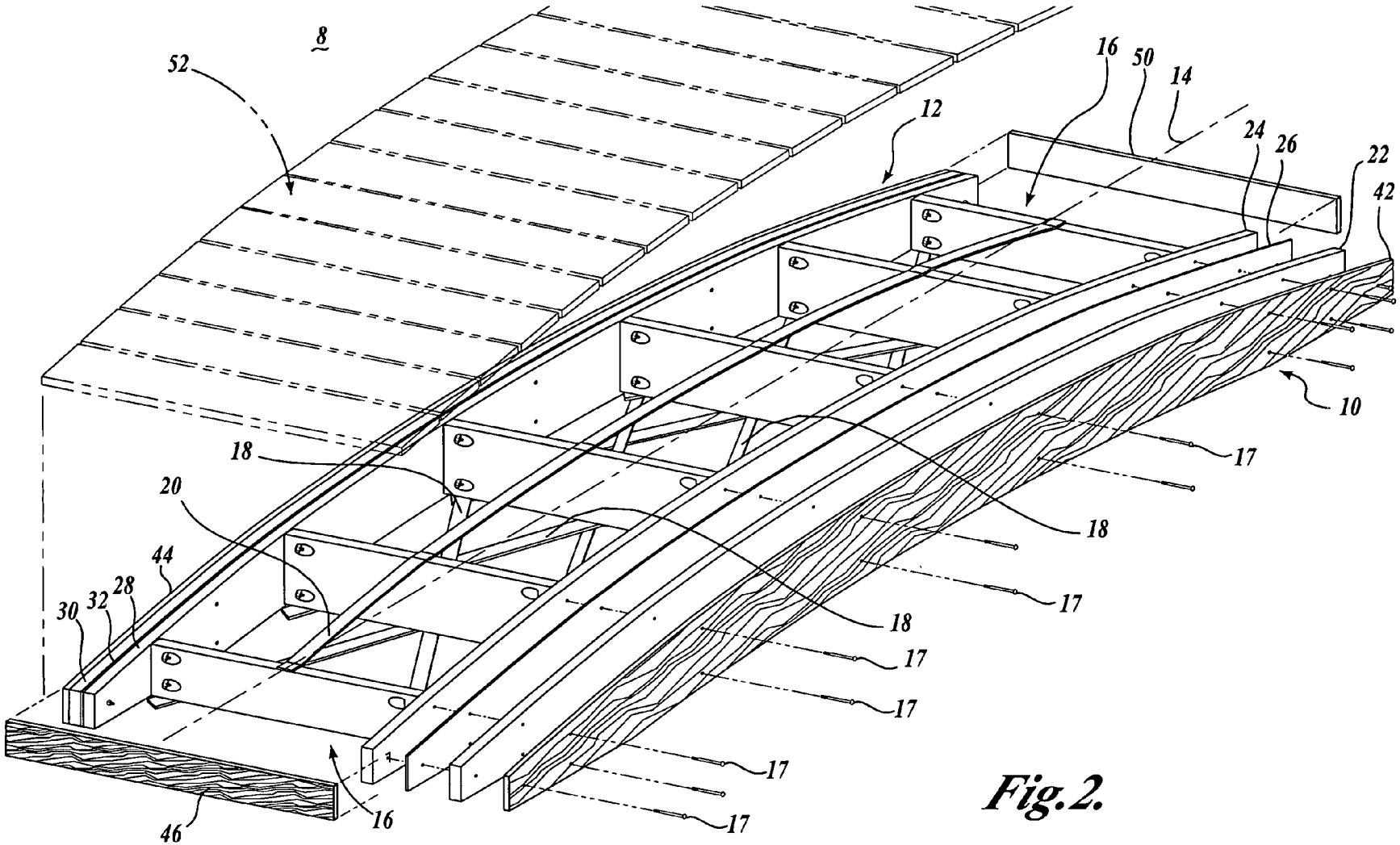
FIG. 2 is an exploded transverse cross-sectional view of the underlying frame of the bridge assembly.

Referring now to FIG. 2, the underlying frame of the ornamental bridge is shown. The frame includes at least a first side beam 10 and a second side beam 12 disposed in a spaced parallel relationship to each other. The side beams 10 and 12 are preferably arched in shape and symmetrical about a longitudinal center axis 14. The side beams 10 and 12 may taper near the end of the beam, however, to provide a substantially flat surface on which the bridge may rest. In order that the bridge kit be shippable to purchasers by standard methods, the first side beam and the second side beam components should be limited in length. For instance, the United Parcel Service™ (UPS) requires that all packages be limited in length to 108 inches, or 9 feet, without incurring additional costs for shipment. Thus, the bridge kit components, including the side beams 10 and 12, should be limited in length to fit within a 9-foot container for shipment by UPS, or other maximum length prescribed by the shipper.

The first side beam 10 is joined to the second side beam 12 with a plurality of transverse braces 16 interspersed between the two side beams 10 and 12. The transverse braces 16 may consist of a foamed plastic that is lightweight, yet strong and durable. Although foamed plastic is the preferred material, other materials may also be used. The first edge of the transverse braces 16 secure to the internal surface of the first side beam 10 and the second edge of the transverse braces 16 secure to the internal surface of the second beam 12. Thus, the transverse braces 16 may be mounted such that they are oriented at substantially perpendicular position to both the first beam 10 and second side beam 12. The braces 16 may be attached with fasteners, such as screws, bolts, or nails 17. Depending on the length of the bridge, an appropriate number of transverse braces 16 may be used. For instance, the 4-foot bridge would likely need 2 transverse braces 16 to provide sufficient support, whereas a 16-foot bridge may use 7 transverse braces 16 for adequate support. An 8-foot bridge, therefore, may use 3 braces, a 10-foot bridge 3 braces, a 12-foot bridge 5 braces, and a 14-foot bridge may use 7 braces. However, fewer or more braces 16 may also be used. Moreover, braces 16 that are smaller in height may be used near the tapered end of the beams 10 and 12.

Still referring to FIG. 2, a plurality of lateral stiffeners 18 may be secured to the bottom edges of the transverse braces 16. The lateral stiffeners 18 may be made of metal, preferably a 16 gauge hot dip galvanized steel. The plurality of lateral stiffeners 18 may be arranged such that each lateral stiffener extends diagonally from the first side beam 10 to the second side beam 12. Each stiffener may be arranged in this fashion, so as to create a criss-cross diagonal pattern within the plurality of lateral stiffeners 18. The lateral stiffeners 18 are then secured to the transverse braces 16 to cooperatively form a more rigid frame. The lateral stiffeners 18 may be secured to the transverse braces 16 with fasteners, such as screws, bolts, or nails.

In addition to the plurality of lateral stiffeners 18, a longitudinal stiffener 20 may be secured to the top edges of the plurality of transverse braces 16. The longitudinal stiffener 20 may be positioned along the longitudinal center axis 14 such that it extends between the first side beam 10 and the second side beam 12. The longitudinal stiffener 20 may be secured to the top edges of the transverse braces 16 with fasteners, such as screws, bolts, or nails.

Still referring to FIG. 2, a detailed illustration of the side beams 10 and 12 is shown. The first side beam 10 may be composed of multiple layers to provide greater strength. The layers may include a first external side rail 22, a first internal side rail 24, and a first plate 26. The first external side rail 22, a first internal side rail 24, and a first plate 26 should be limited in length such that they may fit within a standard shipping container. The first external side rail 22 and the first internal side rail 24 may be formed with a foamed plastic material to provide the first side beam 10 with substantial strength while remaining lightweight. The plate 26 may be made of metal, and preferably a 16 gauge hot dip galvanized steel. After disposing the first plate 26 between the first external side rail 22 and the first internal side rail 24, the layers may be secured together to form the complete first side beam 10. The layers may be secured together with fasteners, such as screws, bolts, or nails.

The second side beam 12 may similarly be composed of multiple layers. The layers may include a second external side rail 28, a second internal side rail 30, and a second plate 32. The second external side rail 28, second internal side rail 30, and second plate 32 should also be limited in length such that they may fit within a standard shipping container. The second external side rail 28 and second internal side rail 30 may be similarly formed from a foamed plastic, and the second plate 32 may be formed from metal. The second plate 32 may be disposed between the second external side rail 28 and the second internal side rail 30, and fasteners may be used to secure the layers to one another.

Figure 3:
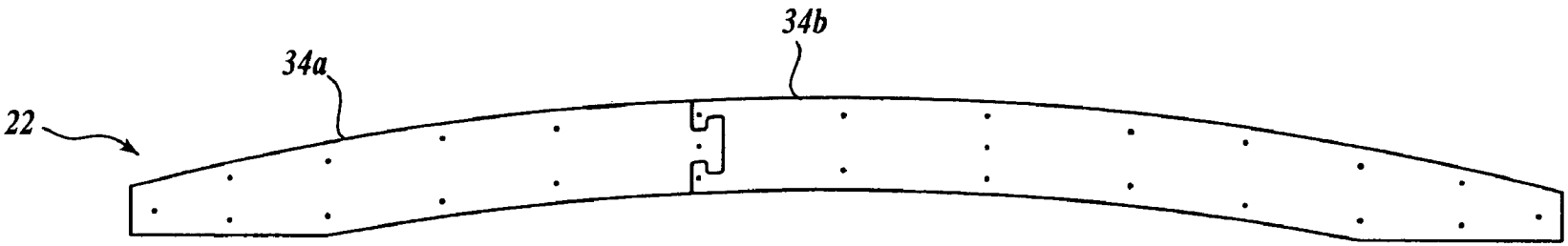
FIG. 3 is a side elevational view of side rail components mated to form an assembled longitudinal side rail.

The first side beam 10 and second side beam 12 may be composed of a plurality of longitudinal components to enable efficient packaging and shipping of the ornamental bridge kit. Thus, for a 16-foot bridge, the first side beam 10 may be broken down into smaller components such that the kit may be packaged and shipped in a standard shipping container. For simplicity and for illustration only, only the first side rail components 34A and 34B will be described in detail. However, the second side rail may have similar components. Referring to FIG. 3, the first external side rail 22 and first internal side rail 24 may be composed of at least two first side rail components 34A and 34B that mate together to form one longitudinal side rail 22 or 24. The first side rail components 34A and 34B may be formed such that they mate together at a joint 36, a mortise and tenon joint. Other types of joints may also be used to mate the components, such as dovetail joint or a dowel joint. The components may then be further secured with fasteners, such as nails, bolts, or screws. Depending on the length of the bridge, the side rails 22 and 24 may be composed of several components that similarly mate together or merely two components that mate together. Moreover, the side rails 22 and 24 need not contain identical components. Rather, the components may be of different lengths to create joints in different locations along the side rails 22 or 24. Furthermore, a small bridge may include side rails 22 or 24 that comprise only a single component of foamed plastic. Regardless, each individual component should be limited in length such that it may fit within a standard shipping container. Thus, it is preferable that each component be less than 9 feet in length.

Figure 4:
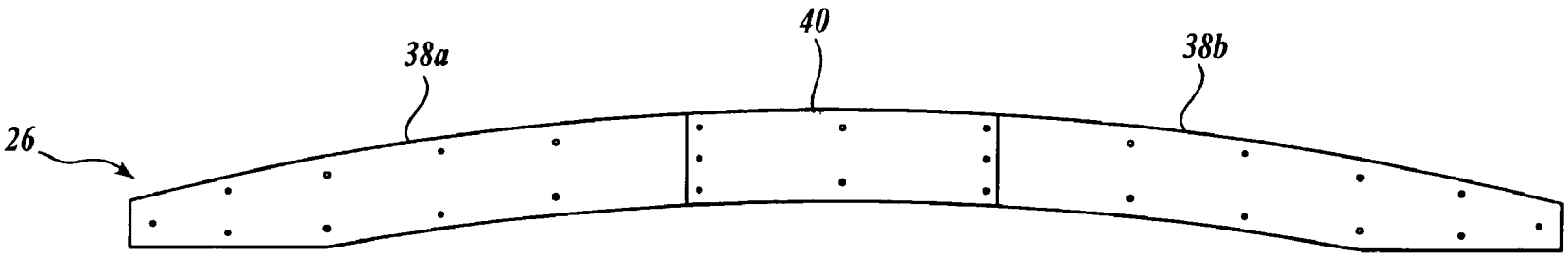
FIG. 4 is a side elevational view of plate components mated to form an assembled plate.

The first plate 26 may also be broken into smaller components to enable the plate to fit within a standard shipping container. Referring to FIG. 4, the first plate 26 may be composed of at least two first plate components 38A and 38B that mate together. Each first plate component 38A and 38B should be limited in length to fit within a standard shipping container. Thus, it is preferable that each first plate component 38A and 38B be less than 9 feet in length. The first plate components may be joined with a scab plate 40, which overlaps the adjacent ends of each plate 38A and 38B and secures to each first plate component 38A and 38B. The scab plate 40 may be secured to the first plate components 38A and 38B by fasteners, such as nails or screws. The scab plate 40 joins the first plate components 38A and 38B to form the first plate 26.

Figure 5:
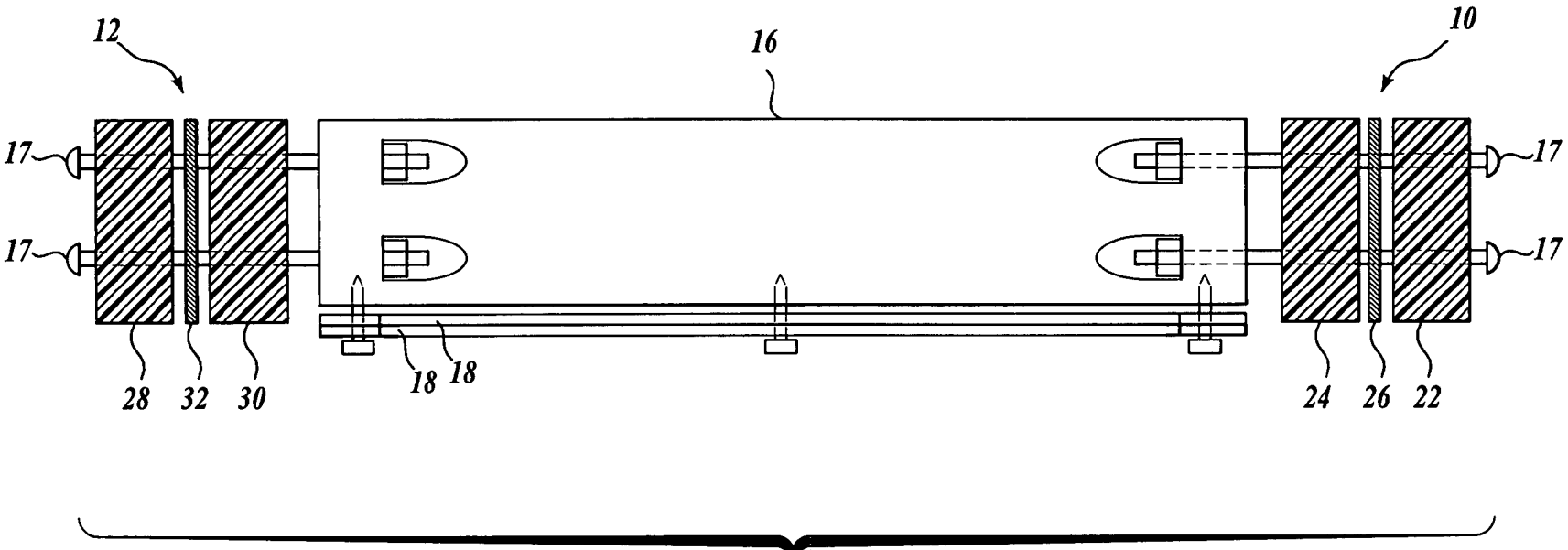
FIG. 5 is a cross-sectional view of the side beams joined with a transverse brace, as shown in FIG. 2.

Now referring to FIG. 5, a cross sectional view of the first side beam 10 and second side beam 12 joined with a transverse brace 16 is shown. Preferable, the layers of the first side beam 10 are secured to the transverse brace 16 with a bolt that passes, in the following order, through the first external side rail 22, the first plate 26, and the first internal side rail 24, and then through a hole in the outer edge of the transverse brace 16 to receive a nut. The second side beam 12 may be secured to the transverse brace 16 in a similar fashion. Although the preferred method includes passing a bolt through the first side beam 10 and the transverse brace 16, other methods of fastening may also be used. Also secured to the transverse brace 16 is a lateral stiffener 18. The lateral stiffener 18 may be secured to the transverse brace 16 with a screw; however, other fasteners may also be used.

Referring back to FIG. 1, the complete bridge is shown. The frame may be concealed with a wood covering to create a pleasing aesthetic image. The first side beam 10 may be covered with a first side covering 42, and the second side beam 12 may be covered with a second side covering 44. Although wood is preferred, the side coverings may consist of a synthetic material, such as plastic. Regardless, each side covering 42 and 44 may also be composed of smaller components for shipping purposes. Thus, it would be preferable that each component be no greater in length than 9 feet. The side coverings 42 and 44 may be secured to the side beams 10 and 12 with fasteners, such as nails, screws, or bolts. The same bolt may be used to secure the coverings 42 and 44 to the external side rails 22 and 28, the plates 26 and 32, the internal side rails 24 and 30, and the transverse brace 16. In the alternative, separate fasteners may be used to secure the coverings 42 and 44 to the side beams 10 and 12.

Rather than using side coverings 42 and 44, the exteriors of the first and second side beams may not be covered; rather, the side beams may be left exposed. To this end, the exterior side rails of the side beams may be textured to simulate wood grain or other design.

Still referring to FIG. 1, a first end covering 46 may be secured to the end of the frame to enclose the end openings. The first end covering 46 may extend transversely from the first end of the first side beam 10 to the first end of the second side beam 12. The first end covering 46 may then be secured to the first end of the first side beam 10 and the first end of the second side beam 12 with fasteners, such as screws, nails, or bolts. A second end covering 50 may similarly be secured to the second end of the first side beam 10 and the second end of the second side beam 12.

A plurality of boards or planks 52 may be arranged transversely across the frame, extending from the first side beam 10 to the second side beam 12. The plurality of boards 52 may be secured to the top edge of the first side beam 10 and the second side beam 12 with fasteners, such as screws, nails, or bolts. The plurality of boards 52 form the bridge platform or deck to complete the bridge.

Handrails may be further added to the bridge if the user so desires. The handrails include posts or risers 54 having their lower ends mounted to the first and second side coverings 44 and 46 with fasteners such as screws, nails, or bolts. In the alternative, the handrails may be directly mounted to the first and second side beams 10 and 12 and then first and second side covering components may later be added to the side beams 10 and 12. Upper railings 56 may extend along the tops of the risers 54 preferably at a height that may be readily grasped by one walking across the bridge.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An ornamental bridge kit, comprising:

(a) a first side beam having a first end, a second end, an internal surface, an external surface, a top edge, and a bottom edge, the first side beam comprising:

(i) a first external side rail having an internal face;

(ii) a first reinforcement plate having an inner face and an outer face, the outer face of the first reinforcement plate mateable to the internal face of the first external side rail;

(b) a second side beam having a first end, a second end, an internal surface, an external surface, a top edge, and a bottom edge, the second side beam comprising:

(i) a second external side rail having an internal face;

(ii) a second reinforcement plate having an inner face and an outer face, the outer face of the second reinforcement member mateable to the internal face of the second external side rail;

(c) a plurality of transverse braces for spanning between the internal surface of the first side beam and the internal surface of the second side beam, said transverse braces having a top surface and a bottom surface; and (d) a plurality of planks for extending transversely between the first side beam and the second side beam and securable to the top edge of the first and second side beams.

2. The ornamental bridge kit of claim 1, wherein the first side beam further comprises a first internal side rail having an internal face, wherein the internal face of the first internal side rail is mateable to the inner face of the first reinforcement plate such that the first reinforcement plate may be sandwiched between the first external side rail and the first internal side rail.

3. The ornamental bridge kit of claim 2, wherein the first side beam further comprises:

a plurality of longitudinal rail components that are mated together to form the first external side rail;

a plurality of longitudinal rail components that are mated together to form the first internal side rail; and a plurality of longitudinal plate components that are secured together to form the first reinforcing plate.

4. The ornamental bridge kit of claim 3, wherein the longitudinal rail components are not greater than about nine feet in length; and the longitudinal plate components are not greater than about nine feet in length.

5. The ornamental bridge kit of claim 1, wherein the second side beam further comprises a second external side rail and a second internal side rail having an internal face, wherein the internal face of the second internal side rail is mateable to the inner face of the second reinforcement plate such that the second reinforcement plate may be sandwiched between the second external side rail and the second internal side rail.

6. The ornamental bridge kit of claim 5, wherein the second side beam further comprises:

a plurality of longitudinal rail components that are mated together to form the second external side rail;

a plurality of longitudinal rail components that are mated together to form the second internal side rail; and a plurality of longitudinal plate components that are secured together to form the reinforcing second plate.

7. The ornamental bridge kit of claim 6, wherein the longitudinal rail components are not greater than about nine feet in length; and the longitudinal plate components are not greater than about nine feet in length.

8. The ornamental bridge kit of claim 1, further comprising a plurality of stiffeners secured to the plurality of transverse braces.

9. The ornamental bridge kit of claim 8, wherein the plurality of stiffeners further comprises a plurality of lateral stiffeners spanning diagonally beneath the plurality of transverse braces and extending between the first side beam and the second side beam, said lateral bracing members secured to the bottom surface of the plurality of transverse braces.

10. The ornamental bridge kit of claim 8, wherein the plurality of stiffeners further comprises at least one longitudinal stiffener secured to the top surface of the plurality of transverse braces and lateral to the first and second side beams.

11. The ornamental bridge kit of claim 1, further comprising:

a first end covering extending transversely from the first end of the first side beam to the first end of the second side beam; and a second end covering extending transversely from the second end of the first side beam to the second end of the second side beam.

12. The ornamental bridge kit of claim 1, further comprising:

a first side covering secured to the external surface of the first side beam; and a second side covering secured to the external surface of the second side beam.

13. The ornamental bridge kit of claim 12, further comprising:

a first handrail secured to the first side beam; and a second handrail secured to the second side beam.

14. An ornamental foot bridge kit, comprising:

(a) first and second side beam structures disposed in spaced parallel relationship by transverse spanning braces between the first and second side beam structures and a plurality of cross planks extending between the first and second side beam structures to form the bridge deck;

(b) wherein each of the first and second side beam structures comprising an external rail extending along the exterior of the side beam structures and a reinforcing member extending along the interior of the side beam structures; and (c) wherein the external rails and reinforcing member are composed of longitudinal segments of a length no longer than nine feet.

15. The ornamental foot bridge of claim 14, wherein the first and second side beam structures further comprising an internal rail extending along the interior of the side beam structure, with the reinforcing member sandwiched between the external and internal rails of the side beam structures.

* * * * *

UNITED STATES PATENT AND TRADEMARK OFFICE

CERTIFICATE OF CORRECTION

PATENT NO. : 7,240,387 B1
APPLICATION NO. : 11/070311
DATED : July 10, 2007
INVENTOR(S) : J. A. Berggren It is certified that error appears in the above-identified patent and that said Letters Patent is hereby corrected as shown below:

| COLUMN | LINE | ERROR |
|---|---|---|
| 6 (Claim 5) | 19 | "a second external side rail and a second internal" should read --a second internal-- |
| 8 (Claim 15) | 7 | after "foot bridge" insert --kit-- |

Signed and Sealed this

Sixth Day of October, 2009

David J. Kappos

David J. Kappos
*Director of the United States Patent and Trademark Office*